US005417156A

United States Patent [19]

Tateishi et al.

[11] Patent Number: 5,417,156

[45] Date of Patent: May 23, 1995

[54] THERMAL STENCIL PLATE MAKING METHOD

[75] Inventors: Hiroshi Tateishi, Fujinomiya; Yuji Natori, Yokohama, both of Japan

[73] Assignee: Ricoh Company, Ltd., Tokyo, Japan

[21] Appl. No.: 127,435

[22] Filed: Sep. 27, 1993

[30] Foreign Application Priority Data

Oct. 2, 1992 [JP] Japan ..... 4-289532

[51] Int. Cl.[6] ..... B41C 1/055

[52] U.S. Cl. ..... 101/128.21; 101/128.4; 400/120.13; 347/171

[58] Field of Search ..... 101/128.21, 128.4, 129, 101/401.1, 127; 400/120.09, 120.13; 346/76 PH

[56] References Cited

U.S. PATENT DOCUMENTS 5,216,951 6/1993 Yokoyama et al. ..... 101/128.4

FOREIGN PATENT DOCUMENTS 253492 11/1987 Japan ..... 101/127
21190 1/1988 Japan ..... 101/128.21
191654 8/1988 Japan ..... 101/128.21
234294 9/1989 Japan ..... 101/128.21
67133 3/1990 Japan ..... 101/128.21
99890 4/1991 Japan ..... 101/127

*Primary Examiner*—Edgar S. Burr
*Assistant Examiner*—Stephen R. Funk
*Attorney, Agent, or Firm*—Cooper & Dunham

[57] ABSTRACT

A thermal stencil plate making method, by which a perforation image is formed on a thermal stencil original sheet comprising a thermoplastic resin film and a porous support laminated on each other or a thermal stencil original sheet composed substantially only of a thermoplastic resin film by applying thermal energy to the thermal stencil original sheet by means of a thermal head, is characterized in that a distance between heating elements in the thermal head: d (μm) and a thickness of a heating element protection layer: T (μm) satisfy the following condition of Equation (1) and that a secondary scan direction heating element spacing between heating elements in the thermal head: D (μm) and the thickness of the heating element protection layer: T (μm) satisfy the following condition of Equation (2):

$$5 \leqq d/T \quad (1);$$

$$4.5 \leqq D/T \quad (2).$$

20 Claims, 1 Drawing Sheet

THERMAL STENCIL PLATE MAKING METHOD

BACKGROUND OF THE INVENTION

1. Field of the Invention

The present invention relates to a thermal stencil plate making method. More particularly, the invention relates to a thermal stencil plate making method using a thermal stencil original sheet in which a thermoplastic resin film and a porous support are laminated to each other. Further, the invention relates to a thermal stencil plate making method using a thermal stencil original sheet substantially made only of a thermoplastic resin film.

2. Description of the Related Art

The screen printing method is conventionally widely used as a simple and easy printing method. This method employs a thermal stencil original sheet in which a thermoplastic resin film is layered on the surface of an appropriate ink-transmissive support. The thermoplastic resin film is heated to fuse by a thermal head or the like to form image-like perforations. Printing ink is introduced from the ink-transmissive support side to effect printing on a printing object such as paper. Alternatively, using a thermal stencil original sheet substantially only of a thermoplastic resin film, the thermoplastic resin film is heated to fuse by a thermal head to form image-like perforations and printing ink is forced through the single thermoplastic resin film to effect printing on a printing object such as paper (in the case of support-less stencil).

The thermal heads for thermal color development recording or for thermal transfer recording have been divertedly used heretofore as the thermal head for the above thermal stencil plate making method. The thermal heads for thermal recording are designed to form a record image of continuous pixels connected to each other. If such thermal heads were used for thermal stencil plate making, the image of perforations would be continuous, which results in increasing offset or in increasing plate wear. Meantime, the diameter of image perforations can be changed by adjusting the energy applied to the thermal head. The perforation diameter becomes larger as the applied energy increases; conversely, it becomes smaller as the applied energy decreases. Employing such technique, there is a method to assure the independency of image perforations. However, the most suitable application energy is to be in the energy range in which the dispersion of perforations in a perforation image is smallest. This condition is generally also to select the maximum application energy in the range in which the durability of the thermal head is increased. Decreasing the applied energy below the suitable value increases the dispersion of image perforations, while increasing the applied energy is not preferable in respect of the durability of the thermal head. Further, a new problem of support-less thermal stencil original sheet appeared such as an abnormal image (especially wrinkles) arisen from plate shrinkage due to thermal shrinkage of a non-image portion.

To solve the above problems in the thermal stencil original sheet with support, there is means of reducing only the thickness of the protection layer of heating elements, proposed in Japanese Patent Application Laying Open (KOKAI) No. 63-191654. However, since the thickness of the protection layer is made extremely thin as 0.5 to 3.5 μm, there are a lot of pin holes in the protection layer. When the humidity is high, an antistatic agent enters the pin holes to cause corrosion of the electrode. Even if the humidity is not so high, the pin holes could cause lack of abrasion resistance. In addition, in case that the thickness of the protection layer is 0.5 μm, the image perforations are liable to be connected to each other if a distance between heating elements is below 2.5 μm ($d/T<5$). Further in this case, especially with the support-less thermal stencil original sheet, the new problem of abnormal image for example of wrinkles is liable to arise from plate shrinkage. Conversely, if the thickness of protection layer is 3.5 μm and if a distance between heating elements is longer than 35 μm ($10<d/T$), the image perforations are separate too far from each other. Especially in case of support-less thermal stencil original sheet, a printed image will lose its continuity, because an ink transfer amount is small because of the property thereof.

Proposed in Japanese Patent Application Laying Open (KOKAI) No. 2-67133 is means to make the secondary scan length of each heating element in the thermal head shorter than the dot pitch in the primary scan direction. It was, however, insufficient, because the master, to which the invention was directed, was the thermal stencil original sheet with support. Wrinkles due to plate shrinkage sometimes appeared especially in making a stencil plate from a support-less stencil original sheet. The degree of wrinkle appearance increases as the film thickness of support-less stencil original sheet becomes thicker. Further, even with a general thermal stencil original sheet, the communication between perforations occurred if the dot pitch in the primary scan direction is made different from that in the secondary scan direction. Especially with support-less thermal stencil original sheet, too far image perforations were sometimes made for the same reason as described above.

SUMMARY OF THE INVENTION

It is, therefore, an object of the present invention to provide a thermal stencil plate making method excellent in plate wear, little in offset, and free from the abnormal image due to plate shrinkage which is the new problem especially in support-less thermal stencil original sheet.

The above object of the present invention can be achieved by a thermal stencil plate making method by which a perforation image is formed on a thermal stencil original sheet comprising a thermoplastic resin film and a porous support laminated on each other or a thermal stencil original sheet composed substantially only of a thermoplastic resin film by applying thermal energy to the thermal stencil original sheet by means of a thermal head, wherein a distance between heating elements in said thermal head: d (μm) and a thickness of a heating element protection layer: T (μm) satisfy the following condition of Equation (1) and wherein a secondary scan direction heating element spacing between heating elements in said thermal head: D (μm) and the thickness of the heating element protection layer: T (μm) satisfy the following condition of Equation (2):

$$5 \leqq d/T \quad (1);$$

$$4.5 \leqq D/T \quad (2).$$

The distance between heating elements in the thermal head herein: d (μm) is a value obtained by subtracting the primary-scan-direction length of heating elements: Lm (μm) from the distance between the heating element centers in the primary scan direction: Pm (μm) (d=Pm−Lm; see FIG. 1*a*).

Also, the secondary-scan-direction heating element spacing of heating elements in the thermal head: D (μm) is a value obtained by subtracting the secondary-scan-direction length of heating elements: Ls (μm) from the feed amount per dot in the secondary scan direction upon plate-making: Ps (μm) (D=Ps−Ls; see FIG. 1*b*).

Further, the above object of the present invention can also be achieved preferably by a thermal stencil plate making method by which a perforation image is formed on a thermal stencil original sheet comprised substantially only of a thermoplastic resin film by applying thermal energy to said film by means of a thermal head, wherein a distance between heating elements in said thermal head: d (μm) and a thickness of a heating element protection layer: T (μm) satisfy the following condition of Equation (3) and wherein a secondary scan direction heating element spacing between heating elements in said thermal head: D (μm) and the thickness of the heating element protection layer: T (μm) satisfy the following condition of Equation (4):

$$5 \leqq d/T \leqq 10 \quad (3):$$

$$4.5 \leqq D/T \quad (4).$$

The present invention enables the plate making little in offset on a print, excellent in plate wear of master plate, and further free from the abnormal image on the print due to plate shrinkage, because image perforations are formed independent of each other, Also with support-less thermal stencil original sheet, there is no support, so that all perforations made by heating elements become ink-transmissive regions, reducing the dispersion of image density among pixels.

Since the distance between hearths elements: D (μm) and the heat element spacing in the secondary scan direction between heating elements: D (μm) are sufficiently large as compared with the thickness of protection layer: T (μm), heat from individual heating elements is transmitted to the perforations can be attained. Namely, the independency of image perforations can be assured be, satisfying following Equations (1) and (2) the present invention.

$$5 \leqq d/T \quad (1)$$

$$4.5 - D/T \quad (2)$$

When above Equations (1) and (2) are satisfied, there is no plate shrinkage caused, in addition to the improvement of independency of image perforations. If the thickness of the protection layer exceeds 7.0 μm so as not to satisfy above Equations (1) and (2), the independency of image perforations will be negatively affected and the thermal response of the thermal head will be lowered (because of increase of heat capacity of the protection layer). Then the line speed of plate-making cannot be increased, and especially the plate shrinkage appears outstanding. If the thickness is below 3.5 μm, the thermal head cannot have sufficient durability. If the distance in the primary scan direction between heat elements in the thermal head and the heating element spacing in the secondary scan direction between heating elements are simultaneously shorter than 17.5 μm so as not to satisfy above Equations (1) and (2), a non-perforated portion is insufficient in a solid print portion even with the independency of image perforations being assured; which especially results in reducing the plate wear.

Especially in case of the support-less thermal stencil original sheet, the gap between image perforations is made suitable in addition to the above effect.

$$5 \leqq d/T \leqq 10 \quad (3)$$

$$4.5 \leqq D/T \quad (4)$$

In more detail, when Equations (3) and (4) are satisfied, the continuity of printed image (solid evenness) becomes especially excellent even with a small ink transfer amount because of the property of support-less thermal stencil original sheet.

The difference of range between Equations (1), (2) and Equations (3), (4) is due to the characteristics of the thermal head. In more detail, the heating elements are not aligned in the secondary scan direction of the thermal head, so that when two perforations adjacent to each other are made in the secondary scan direction, heating of the thermal head for the two perforations are not simultaneous. Accordingly, the heat distribution for two perforations adjacent to each other in the secondary scan direction is different from that for two perforations adjacent to each other in the primary scan direction. Therefore, the ranges of two corresponding equations are different from each other.

BRIEF DESCRIPTION OF THE DRAWINGS

The thermal head employed in the present invention is of the same type of structure as the thin-film type thermal head usable in thermal printers. The thermal head is constructed as follows. As shown in FIG. 2, a thermal resistance layer 7 made of glass is formed on an insulating base 8, and an electrode layer 9 of metal material such as NiCr, Ta, etc. is formed by the vapor deposition method through a heating resistor layer 8 over the thermal resistance layer. In a heating portion, a non-oxidizable layer 10 is directly formed on the heating resistor layer, forming a concave heating portion 12. There are two types of thin-film type thermal heads, i.e., completely glazed thermal head as shown in FIG. 2 and partially glazed thermal head (not shown), either of which satisfies the same equations.

Figure 1A:
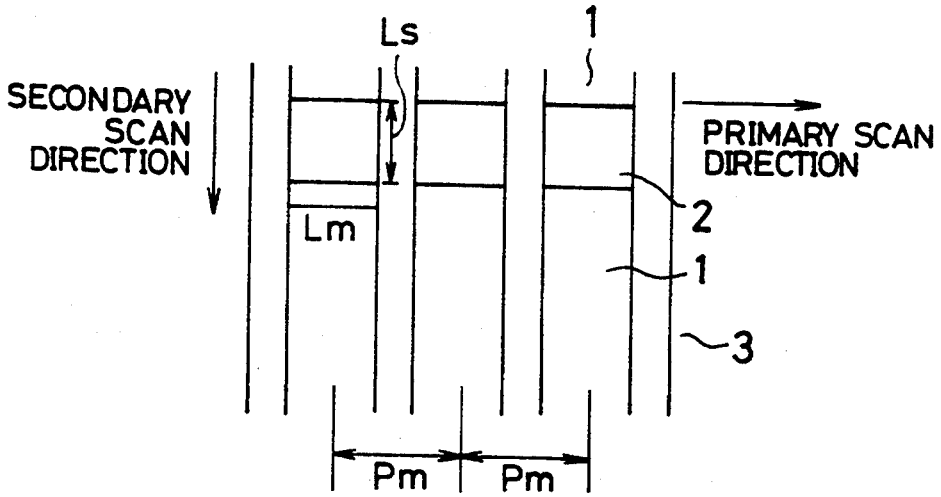
FIG. 1*a* is a schematic plan view of a thermal head.
Figure 1B:
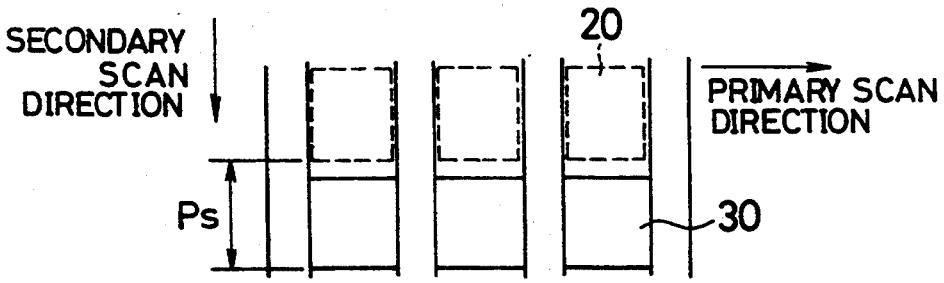
FIG. 1*b* is a schematic plan view to show heating locations of heating elements in a thermal head.
Figure 2:
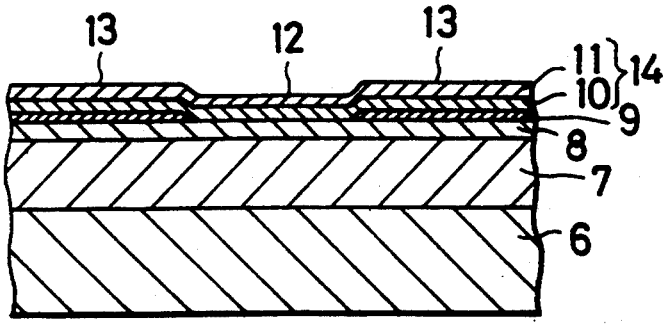
FIG. 2 is a cross sectional view of a thermal head.

The present invention is effective to make independent perforation dots whereby excellent prints can be provided with superior image reproducibility, with minimum offset, and with no wrinkle on image which could be caused by the plate shrinkage especially liable to occur in the support-less thermal stencil original sheet. Further, the durability of the plate-making machine, specifically of the thermal head, is excellent.

The thermoplastic resin film may be any of general thermoplastic resin films formed by the extrusion process, the casting process or another process. The thermoplastic resin film may be selected from the group consisting of polyester (preferably copolymer polyester) type, polyamide (preferably copolymer polyamide) type, polyolefin type, polystyrene type, polyvinyl chloride type, acrylic acid derivative type, ethylene-vinyl alcohol type and polycarbonate type copolymers. The film preferably has a high perforation sensitivity. For that reason, the thermoplastic resin should preferably have a degree of crystallinity ranging from the substantially amorphous level to 15% in the state of film. More preferably, the film is substantially amorphous. The film of substantially amorphous level means that the raw material shows little melting point by the DSC method, or that the film is made while suppressing the crystallization by the processing method (for example by quench). If the degree of crystallinity is high, the energy from the thermal head is dissipated as energy for crystal melting, affecting the perforation property.

The degree of crystallinity is determined by the X-ray method, but it can also be obtained by the DSC method, using an area ratio of fusing energy.

More preferably, the film mainly contains a copolymer polyester and is of substantially amorphous level. Most preferably, the copolymer polyester as raw material is substantially amorphous. The substantially amorphous polyester is different from the commercially available resin mainly containing so-called highly crystalline polyethylene terephthalate having a crystalline melting point (measured by the DSC method) in the range of 245° to 260 ° C., but is a composition comprising a polymer or polymer blend and having a degree of crystallinity of not more than 10%, preferably not more than 5%, more preferably one with a melting point scarcely observed by the DSC method. The measurement of crystallinity degree is carried out using the above composition fully annealed into an equilibrium state and fixed in degree of crystallinity by the X-ray method as a reference. Using the thermoplastic film of such low crystalline type, the energy loss as crystal melting energy may be reduced, so that the thermal perforation may be fully effective with a small amount of energy applied to the thermal head.

The thickness of the thermoplastic resin film employed in the present invention is preferably in the range of 0.5 μm to 30 μm, more preferably in the range of 0.7 to 20 μm. If the thickness is too thin, the plate wear will be degraded in particular because of the low mechanical strength, though the perforations are sufficiently independent of each other. Conversely, if the thickness is too thick, the perforation becomes hard and the plate-making wrinkles readily appear.

The melting start temperature should be in the range of 50° C. to 300° C., preferably in the range of 70 ° C. to 290 ° C. A too low melting start temperature makes the production of film difficult and lowers the shelf stability as a product of thermal stencil original sheet. A too high melting start temperature causes the energy necessary for perforation from the thermal head to the thermal stencil original sheet to increase, whereby the perforation becomes difficult.

The raw material for the porous support may be natural fibers such as kozo (paper mulberry), mitsumata and Manila hemp; semisynthetic fibers such as rayon; synthetic fibers such as polyester, vinylon, polyamide and polypropylene, used alone or in combination of at least two thereof at weight of 8 to 15 g/m$^2$. An additive such as an antistatic agent may be added in the porous support. Further, the support may be a porous resin film which can transmit ink.

The adhesive for laminating the thermoplastic resin film to the porous support may be one selected from the group comprising acrylic resins, vinyl acetate resins, vinyl acetate resins containing rosin resin, methoxypolyamides, vinyl chloride copolymers, chlorinated polypropylene resins, urethane adhesives of reaction prepolymers from di-isocyanate and polyether diol, mixture adhesives from active hydrogen containing resin and polyisocyanate, ultraviolet curing adhesives, and electron radiation curing adhesives.

An anti-fusion-bonding treatment may be effected on the thermoplastic resin film on the side thereof to contact with the thermal head, if the perforating means is the thermal head. The anti-fusion-bonding treatment can be done by the method of uniformly applying an anti-fusion-bonding agent selected from fatty acid metal salts, phosphate surface active agents, fluid lubricants such as silicone oil, and fluorine compounds having a perfluoroalkyl group.

An amount of coating is in the range of 0.001 to 2 g/m$^2$preferably in the range of 0.005 to 1 g/m$^2$. A too small amount of coating cannot reveal the anti-fusion-bonding effect, while a too large amount of coating negatively affects the perforation function.

The method of providing the thermoplastic resin film with the antistatic effect may be a method of uniformly coating the thermoplastic resin film with an antistatic agent or a method of mixing an antistatic agent into the thermoplastic resin film.

The antistatic agent used in the method of coating may be, one of general antistatic agents such as metal salts of organosulfonic acids, polyalkylene oxides, esters, amines, polyethoxy derivatives, carboxylates, amine guanidine salts quarternary ammonium salts, and alkyl phosphates.

A coating amount of the antistatic agent is in the range of 0.001 to 2.0 g/m$^2$, preferably in the range of 0.01 to 0.5 g/m$^2$. A too small coating amount cannot present the sufficient antistatic effect especially in the environment of low humidity; conversely, a too large coating amount will negatively affect the perforation function as well as the effect of the anti-fusion-bonding agent.

The antistatic agent used in the method of mixing it in the thermoplastic resin film may be selected from metal salts of organosulfonic acids, polyalkylene oxides, or one or more mixtures of quarternary ammonium salts.

The metal salts of organosulfonic acids compounds represented by the formula of $RSO_3X$ (where R is an alliphatic group, an alicyclic group or an aromatic group and X is a metal, for example Na, K, Li), specifically, metal salts of alkylsulfonic acids or metal salts of alkylbenzenesulfonic acids for example. The alkyl may be octyl, decyl, dodecyl (lauryl), tetradecyl (myristyl), hexadecyl, octadecyl (stearyl) and the like, for example. Further specific compounds may be laurylsulfonic acid sodium salt, laurylsulfonic acid potassium salt, laurylsulfonic acid lithium salt, stearylsulfonic acid sodium salt, stearylsulfonic acid potassium salt, stearylsulfonic acid lithium salt, dodecylbenzenesulfonic acid sodium salt, dodecylbenzenesulfonic acid potassium salt, dodecylbenzenesulfonic acid lithium salt or the like for example. The content of organosulfonic acid metal salt is in the range of 0.1 to 2% by weight relative to the thermoplastic resin film, preferably in the range of 0.2 to 1.5% by weight. If the content of organosulfonic acid metal salt is less than 0.1% by weight, the antistatic effect appears little; if over 2% by weight, the surface of thermally perforated sheet undesirably becomes rough.

Also, the polyalkylene oxides to be contained in the thermoplastic resin film may be polyethylene oxides, polypropylene oxides, polyethylene-propylene oxide polymers, polytetramethylene oxides, or the like for example, and the molecular weight thereof is in the range of 400 to 500,000, preferably 1,000 to 50,000.

The content of polyalkylene oxide is in the range of 0.1 to 5% by weight relative to the thermoplastic resin film, preferably in the range of 0.2 to 4% by weight. If the content of polyalkylene oxide is less than 0.1% by weight, the antistatic effect is not enough; if over 5% by weight, the mechanical properties of film will be undesirably degraded.

The electrically conductive agents to be contained in the thermoplastic resin film may be one or more of quarternary ammonium salts represented by the formula of $[R—N(CH_3)_2—R']X$ (where R is an alkyl group having a carbon number of 12 to 18, R' is an alkyl or methyl group having a carbon number of 12 to 18, and X is Cl or Br, or $HSO_4$ or $C_2H_5SO_4$).

The content of the ammonium salt should be preferably in the range of 1 to 50% by weight based on the thermoplastic resin film, more preferably in the range of 2 to 30% by weight.

Further objects and advantages of the present invention will be apparent from the following description of the preferred embodiments of the invention as illustrated in the accompanying drawings.

Reference numerals and symbols in the drawings represent the following elements or portions;

1: electrode;
2: heating element;
Ps: feed amount per dot;
Lm: length of heating element in the primary scan direction;
Ls: length of heating element in the secondary scan direction;
3: thermal head;
6: insulating base;
7: thermal resistance layer;
8: heating resistor layer;
9: electrode layer;
10: non-oxidizable layer;
11: wear-resistant layer;
12: heating portion;
13: electrode portion;
14 : protection layer;
20: hypothetical position of conventional heating element;
30: heating position of heating element of the present invention.

DESCRIPTION OF THE PREFERRED EMBODIMENTS

The present invention will be further described in detail with the following embodiments, but it should be noted that the present invention is not intended to be limited by these examples.

EXAMPLE 1

Used as the thermoplastic resin film was a substantially amorphous film (the degree of crystallinity of 1.0%) with thickness of 1.8 μm and melt temperature of 160° C. mainly containing a copolymer polyester. The film was laminated to a porous support of 11 g/m² made of 15% of polyester fibers and 85% of Manila hemp. The laminate was coated on the side thereof to contact with the thermal head with a phosphate surface active agent (GAFAX RL210 with mp. 54° C. manufactured by TOHO CHEMICAL INDUSTRY) at 0.1 g/m² to form an anti-fusion-bonding layer, whereby a thermal stencil original sheet was obtained with the porous support.

A stencil plate including a black solid image portion was made from the thermal stencil original sheet, using a thin-film type thermal head of 16 dots/mm (heating element primary scan length Lm: 42 μm; secondary scan length Ls: 32 μm; thickness of heating element protection layer T: 4.0 μm; feed amount in the secondary scan direction upon plate-making Ps: 62.5 μm) with energy enough to produce perforations at the probability of not less than 90% being applied to the thermal head. The thermoplastic resin film after the plate-making was set in PRIPORT SS 955 manufactured by RICOH Co., LTD., and printing was carried out. Images obtained were excellent in solid evenness and little in offset. No wrinkles due to the plate shrinkage were observed on the images. The plate wear was also satisfactory.

In this example, d/T=5.1 and D/T=7.6.

EXAMPLE 2

Used as the thermoplastic resin film was a substantially amorphous film (the degree of crystallinity of 1.0%) with thickness of 1.8 μm and melting temperature of 160° C. mainly containing a copolymer polyester. The film was coated on the side thereof to contact with the thermal head with a phosphate surface active agent (GAFAX RL210 with mp. 54° C. manufactured by TOHO CHEMICAL INDUSTRY) at 0.1 g/m² as anti-fusion-bonding layer.

A stencil plate including a black solid image portion was made from the thermoplastic resin film, using a thin-film type thermal head of 16 dots/mm (heating element primary scan length Lm: 45 μm; secondary scan length Ls: 45 μm; thickness of heating element protection layer T: 3.5 μm; feed amount in the secondary scan direction upon plate-making Ps: 62.5 μm) with energy enough to produce perforations at the probability of 100% being applied to the thermal head. The thermoplastic resin film after plate-making was set in PRIPORT SS 955 manufactured by RICOH Co., LTD. and printing was carried out. Images obtained were excellent in solid evenness and little in offset. There were no wrinkles due to the plate shrinkage observed on the images. Also, the plate wear was satisfactory.

In this example, d/T=5.0 and D/T=5.0.

EXAMPLE 3

Used as the thermoplastic resin film was a film with thickness of 2.5 μm and the degree of crystallinity of 20% mainly containing polyethylene terephthalate. The film was coated on the side thereof to contact with the thermal head with a phosphate surface active agent (GAFAX RL210 with mp. 54° C. manufactured by TOHO CHEMICAL INDUSTRY) as anti-fusion-bonding layer and a quarternary ammonium salt of dodecyltrimethylammonium chloride $[C_{12}H_{25}N(CH_3)_2CH_3Cl]$ as antistatic agent at the weight ratio of 1:1 at 0.2 g/m².

A stencil plate including a black solid image portion was made from the thermoplastic resin film, using a thin-film type thermal head of 16 dots/mm (heating element primary scan length Lm: 31 μm; secondary scan length Ls: 38 μm; thickness of heating element protection layer T: 4.0 μm; feed amount in the secondary scan direction upon plate-making Ps: 62.5 μm) with energy enough to produce perforations at the probability of 100% being applied to the thermal head. The thermoplastic resin film after plate-making was set in PRIPORT SS 955 manufactured by RICOH Co., LTD.

and printing was carried out. Images obtained were excellent in solid evenness and little in offset. There were no wrinkles due to the plate shrinkage observed on the images. Also, the plate wear was satisfactory.

In this example, d/T=7.9 and D/T=6.1

EXAMPLE 4

Used as the thermoplastic resin film was a substantially amorphous film (the degree of crystallinity of 1.0%) with thickness of 7.5 μm and melting temperature of 160° C. mainly containing a copolymer polyester. The film was coated on the side thereof to contact with the thermal head with a phosphate surface active agent (GAFAX RL210 with mp. 54° C. manufactured by TOHO CHEMICAL INDUSTRY) as anti-fusion-bonding layer and a quarternary ammonium salt of dodecyltrimethylammonium chloride [$C_{12}H_{25}N(CH_3)_2CH_3Cl$] as antistatic agent at the weight ratio of 1:1 at 0.2 g/m$^2$.

A stencil plate including a black solid image portion was made from the thermoplastic resin film, using a thin-film type thermal head of 12 dots/mm (heating element primary scan length Lm: 45 μm; secondary scan length Ls: 50 μm: thickness of heating element protection layer T: 4.0 μm; feed amount in the secondary scan direction upon plate-making Ps: 83.3 μm) with energy enough to produce perforations at the probability of 100% being applied to the thermal head. The thermoplastic resin film after plate-making was set in PRIPORT SS 955 manufactured by RICOH Co., LTD. and printing was carried out. Images obtained were excellent in solid evenness and little in offset. There were no wrinkles due to the plate shrinkage observed on the images. Also, the plate wear was satisfactory.

In this example, d/T=9.6 and D/T=8.3.

EXAMPLE 5

Used as the thermoplastic resin film was a substantially amorphous film (the degree of crystallinity of 1.0%) with thickness of 5.5 μm and melting temperature of 160° C. mainly containing a copolymer polyester. The film was coated on the side thereof to contact with the thermal head with a phosphate surface active agent (GAFAX RL210 with mp. 54° C. manufactured by TOHO CHEMICAL INDUSTRY) as anti-fusion-bonding layer and a quarternary ammonium salt of dodecyltrimethylammonium chloride [$C_{12}H_{25}N(CH_3)_2CH_3Cl$] as antistatic agent at the weight ratio of 1:1 at 0.2 g/m$^2$. A stencil plate including a black solid portion was made from the thermoplastic resin film, using a thin-film type partially glazed thermal head of 12 dots/mm (heating element primary scan length Lm: 45 μm; secondary scan length Ls: 50 μm; thickness of heating element protection layer T: 7.0 μm; feed amount in the secondary scan direction upon plate-making Ps: 83.3 μm) with energy enough to produce perforations at the probability of 100% being applied to the thermal head. The thermoplastic resin film after plate-making was set in PRIPORT SS 955 manufactured by RICOH Co., LTD. and printing was carried out. Images obtained were excellent in solid evenness and little in offset. There were no wrinkles due to the plate shrinkage observed on the images. Also, the plate wear was satisfactory.

In this example, d/T=5.5 and D/T=4.8.

Comparative Example 1

A stencil plate including a black solid portion was made from the same thermal stencil original sheet as that in Example 1, using a thin-film type completely glazed thermal head of 16 dots/mm (heating element primary scan length Lm: 45 μm; secondary scan length Ls: 58 μm: thickness of heating element protection layer T: 3.5 μm; feed amount in the secondary scan direction upon plate-making Ps: 62.5 μm). When energy enough to produce perforations at the probability of not less than 90% was applied to the thermal head, numerous communications were made between perforations in the secondary scan direction, which extremely lowered the plate wear. On the other hand, if the applied energy is within the range not to cause the communications between perforations in the secondary scan direction, the probability to produce perforations becomes lower, degrading the solidness of solid image.

In this example d/T=5.0 and D/T=1.3.

Comparative Example 2

Used as the thermoplastic resin film was a substantially amorphous film (the degree of crystallinity of 1.0%) with thickness of 5.5 μm and melting temperature of 160° C. mainly containing a copolymer polyester. The film was coated on the side thereof to contact with the thermal head with a phosphate surface active agent (GAFAX RL210 with mp. 54° C. manufactured by TOHO CHEMICAL INDUSTRY) as anti-fusion-bonding layer and a quarternary ammonium salt of dodecyltrimethylammonium chloride [$C_{12}H_{25}N(CH_3)_2CH_3Cl$] as antistatic agent at the weight ratio of 1:1 at 0.2 g/m$^2$. A stencil plate including a black solid portion was made from the thermoplastic resin film, using a thin-film type completely glazed thermal head of 16 dots/mm (heating element primary scan length Lm: 45 μm; secondary scan length Ls: 58 μm; thickness of heating element protection layer T: 3.5 μm; feed amount in the secondary scan direction upon plate-making Ps: 62.5 μm). When the energy enough to produce perforations at the probability of 100% was applied to the thermal head, numerous communications were made between perforations, which extremely lowered the plate wear. The thermal shrinkage was observed locally especially in the secondary scan direction or totally depending upon the image on the stencil master plate after plate-making, which caused wrinkles on printed images.

In this example d/T=5.0 and D/T=1.3.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal stencil plate making method by which a perforation image is formed on a thermal stencil original sheet comprising a thermoplastic resin film and a porous support laminated on each other for making prints with minimum offset, said method comprising the steps of:

moving a thermal head on said thermal stencil original sheet in a secondary scanning direction which is perpendicular to a primary scanning direction; and applying thermal energy to the thermal stencil original sheet by means of said thermal head, wherein a distance between heating elements in said thermal head in the primary scanning direction: d(μm) and a thickness of a heating element protection layer: T(μm) satisfy the following condition of Equation (1) and wherein a distance between heating elements in said thermal head in the secondary scanning direction: D(μm) and the thickness of the heating element protection layer: T(μm) satisfy the following condition of Equation (2):

$$5 \leqq d/T \quad (1);$$

$$4.5 \leqq D/T \quad (2).$$

2. A thermal stencil plate making method according to claim 1, wherein the thickness of said heating element protection layer in the thermal head is in the range of 3.5 to 7.0 μm.

3. A thermal stencil plate making method according to claim 1, wherein the distance between heating elements in the thermal head in the primary scanning direction and the distance between heating elements in the thermal head in the secondary scanning direction both are not less than 17.5 μm.

4. A thermal stencil plate making method according to claim 1, wherein said thermoplastic resin film is a copolymer selected from the group consisting of polyester type, polyolefin type, polystyrene type, polyvinyl chloride type, acrylic acid derivative type, ethylene-vinyl alcohol type, and polycarbonate type copolymers.

5. A thermal stencil plate making method according to claim 4, wherein said thermoplastic resin film is made mainly of a substantially amorphous copolymer polyester.

6. A thermal stencil plate making method according to claim 5, wherein said thermoplastic resin forming the thermoplastic resin film is substantially amorphous.

7. A thermal stencil plate making method according to claim 5, wherein the thermoplastic resin film is substantially amorphous.

8. A thermal stencil plate making method according to claim 1, wherein the thermoplastic resin film has a degree of crystallinity from a substantially amorphous level to 15%.

9. A thermal stencil plate making method according to claim 1, wherein the thickness of said thermoplastic resin film is in the range of 0.5 to 7.0 μm.

10. A thermal stencil plate making method according to claim 1, wherein a melting start temperature of the thermoplastic resin film is in the range of 50° C. to 300° C.

11. A thermal stencil plate making method according to claim 1, comprising the further step of anti-fusion-bonding the thermoplastic resin film on a side thereof to contact with the thermal head.

12. A thermal stencil plate making method according to claim 11, wherein said step of anti-fusion bonding comprises using an anti-fusion bonding agent selected from the group consisting of fatty metal salts, phosphate surface active agents, fluid lubricants, and fluorine compounds having perfluoroalkyl group.

13. A thermal stencil plate making method by which a perforation image formed on a thermal stencil original sheet, comprised substantially only of a thermoplastic resin film for making a thermal stencil plate, is free from plate shrinkage, said method comprising the steps of:

moving a thermal head on said thermal stencil original sheet in a secondary scanning direction which is perpendicular to a primary scanning direction;

by applying thermal energy to said thermal stencil original sheet by means of said thermal head, wherein a distance between heating elements in said thermal head in the primary scanning direction: d(μm) and a thickness of a heating element protection layer: T(μm) satisfy the following condition of Equation (3) and wherein a distance between heating elements in said thermal head in the secondary scanning direction: D(μm) and the thickness of the heating element protection layer: T(μm) satisfy the following condition of Equation (4):

$$5 \leqq d/T \leqq 10 \quad (3);$$

$$4.5 \leqq D/T \leqq 9 \quad (4).$$

14. A thermal stencil plate making method according to claim 13, wherein the thickness of said heating element protection layer in the thermal head is in the range of 3.5 to 7.0 μm.

15. A thermal stencil plate making method according to claim 13, wherein the distance between heating elements in the thermal head in the primary scanning direction and the distance between heating elements in said thermal head in the secondary scanning direction both are not less than 17.5 μm.

16. A thermal stencil plate making method according to claim 13, wherein said thermoplastic resin film is a copolymer selected from the group consisting of polyester type, polyolefin type, polystyrene type, polyvinyl chloride type, acrylic acid derivative type, ethylene-vinyl alcohol type, and polycarbonate type copolymers.

17. A thermal stencil plate making method according to claim 13, wherein the thermoplastic resin film has a degree of crystallinity ranging from a substantially amorphous level to 15%.

18. A thermal stencil plate making method according to claim 13, wherein the thickness of said thermoplastic resin film is in the range of 0.5 to 7.0 μm.

19. A thermal stencil plate making method according to claim 13, wherein a melting start temperature of the thermoplastic resin film is in the range of 50° C. to 300° C.

20. A thermal stencil plate making method according to claim 13, comprising the further step of anti-fusion-bonding the thermoplastic resin film on a side thereof to contact with the thermal head.

* * * * *